US012345055B1

(12) United States Patent
Santini

(10) Patent No.: US 12,345,055 B1
(45) Date of Patent: Jul. 1, 2025

(54) ALUMINUM EXTRUDED PLANK

(71) Applicant: Patrick J. Santini, West Bend, WI (US)

(72) Inventor: Patrick J. Santini, West Bend, WI (US)

( * ) Notice: Subject to any disclaimer, the term of this patent is extended or adjusted under 35 U.S.C. 154(b) by 236 days.

(21) Appl. No.: 18/202,373

(22) Filed: May 26, 2023

(51) Int. Cl.
*E04F 15/06* (2006.01)
*E04F 15/02* (2006.01)

(52) U.S. Cl.
CPC ..... *E04F 15/06* (2013.01); *E04F 15/02044* (2013.01); *E04F 2015/02094* (2013.01)

(58) Field of Classification Search
CPC ..... E04F 15/06; E04F 15/02044; E04F 2015/02094
See application file for complete search history.

(56) References Cited

U.S. PATENT DOCUMENTS 6,131,355 A * 10/2000 Groh ..... E04B 5/12 52/592.1
6,324,796 B1 * 12/2001 Heath ..... E04F 15/105 52/579
10,011,979 B1 * 7/2018 Kwong ..... E04C 2/08
10,760,283 B2 * 9/2020 Carrubba ..... E04F 15/02033

FOREIGN PATENT DOCUMENTS

KR 102572794 B1 * 8/2023

OTHER PUBLICATIONS

A specification sheet of a ModTruss Steel Plank 3" published at least as early as Jan. 2, 2020.

* cited by examiner

*Primary Examiner* — Travis M Figg
(74) *Attorney, Agent, or Firm* — Donald J. Ersler

(57) ABSTRACT

An aluminum extruded plank preferably includes a top member, a first side member, a second side member and a middle support member. The first side member extends downward from a first end of the top member. The second side member extends downward from a second end of the top member. A first bottom member extends inward from a bottom end of the first bottom member. A second bottom member extends inward from a bottom end of the second bottom member. The middle support member preferably includes at least one middle side member and a middle bottom member. A lengthwise engagement hook extends outward from an upper portion of the first side member. A lengthwise hook slot is formed in an upper portion of the second side member to receive the lengthwise engagement hook.

15 Claims, 4 Drawing Sheets

ALUMINUM EXTRUDED PLANK

BACKGROUND OF THE INVENTION

1. Field of the Invention

The present invention relates generally to work structures and more specifically to an aluminum extruded plank, which is secured to a work frame for performing elevated work tasks, such as work on airplane fuselages, general access platforms and mezzanines.

2. Discussion of the Prior Art

The prior art discloses a steel plank manufactured by ModTruss of Allentown, Wisconsin. The steel plank has two vertical supports. Adjacent steel planks must be joined to each other with fasteners. When someone steps on a steel plank, it deflects and creates a lip on opposing edges thereof. The lip will provide resistance to rolling a cart over the lip and create tripping hazard. U.S. Pat. No. 6,131,355 to Groh et al. discloses a deck plank. U.S. Pat. No. 6,324,796 to Heath discloses modular decking planks.

Accordingly, there is clearly felt need in the art for an aluminum extruded plank, which is secured to a work frame for performing elevated work tasks, such as work on an airplane fuselage; contains six vertical support members instead two; includes hook and hook slots to eliminate having to secure adjacent planks with fasteners; and a fastener slot for fastening the plank to a support structure in unlimited increments as opposed to a predefined hole pattern.

SUMMARY OF THE INVENTION

The present invention provides an aluminum extruded plank, which is secured to a work frame for performing elevated work tasks on airplane fuselages, general access platforms and mezzanines. The aluminum extruded plank preferably includes a top member, a first side member, a second side member and a middle support member. The top member preferably includes a plurality of lengthwise raised ridges formed on a top surface thereof. The first side member extends downward from a first end of the top member. The second side member extends downward from a second end of the top member. A first bottom member extends inward from a bottom end of the first bottom member. A second bottom member extends inward from a bottom end of the second bottom member. A first gusset member extends from a bottom and an inside surface of the first side member to a bottom surface of the top member. A second gusset member extends from a bottom and an inside surface of the second side member to a bottom surface of the top member.

The middle support member preferably includes a first middle side member, a second middle side member and a middle bottom member. One end of the first and second middle side members extend downward from an bottom surface of the top member and opposing end of the first and second middle side members are terminated with the middle bottom member. A first lengthwise fastener slot is created between an end of the first bottom member and a first edge of the middle bottom member. A second lengthwise fastener slot is created between an end of the second bottom member and a second edge of the middle bottom member. A lengthwise engagement hook extends outward from an upper portion of the first side member. A lengthwise hook slot is formed in an upper portion of the second side member to receive the lengthwise engagement hook. The lengthwise hook slot is sized and positioned to receive a lengthwise engagement hook from an adjacent aluminum extruded plank. The lengthwise engagement hook and engagement hook slot allow adjacent aluminum extruded planks to be engaged with each other.

Accordingly, it is an object of the present invention to provide an aluminum extruded plank, which is secured to a work frame for performing elevated work tasks, such as work on airplane fuselage.

It is another object of the present invention to provide an aluminum extruded plank, which contains six vertical support members instead two.

It is a further object of the present invention to provide an aluminum extruded plank, which includes hook and hook slots to eliminate having to secure adjacent planks with fasteners.

Finally, it is another object of the present invention to provide an aluminum extruded plank, which includes a fastener slot for fastening the plank to a support structure in unlimited increments as opposed to a predefined hole pattern.

These and additional objects, advantages, features and benefits of the present invention will become apparent from the following specification.

DETAILED DESCRIPTION OF THE PREFERRED EMBODIMENTS

Figure 1:
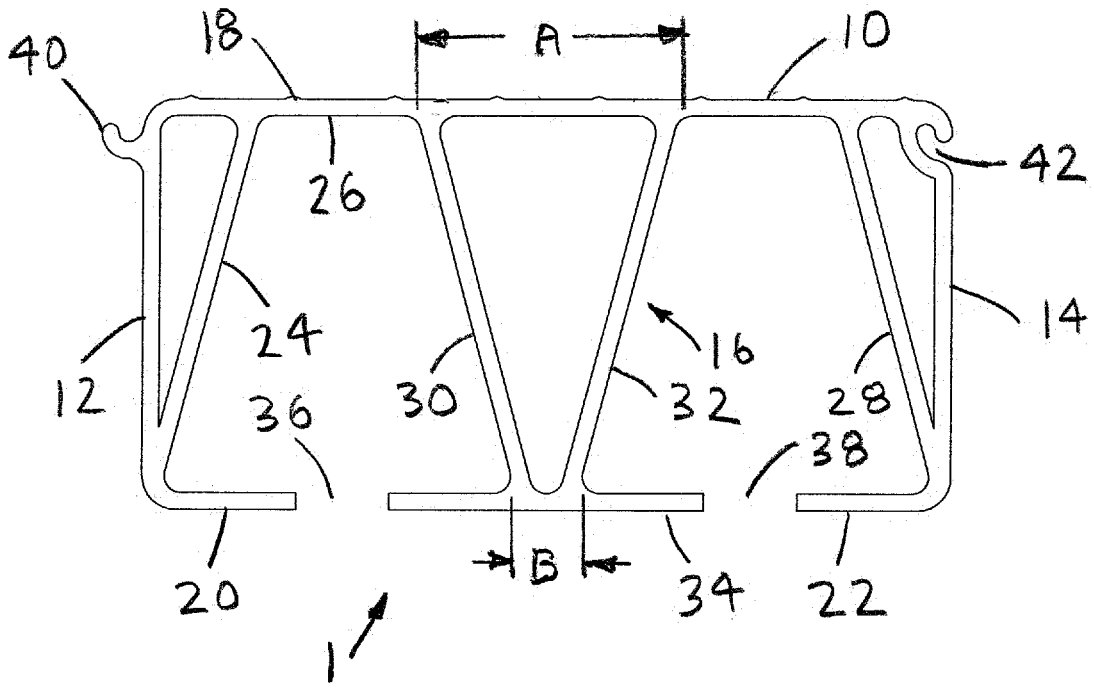
FIG. 1 is a front view of an aluminum extruded plank in accordance with the present invention.
Figure 2:
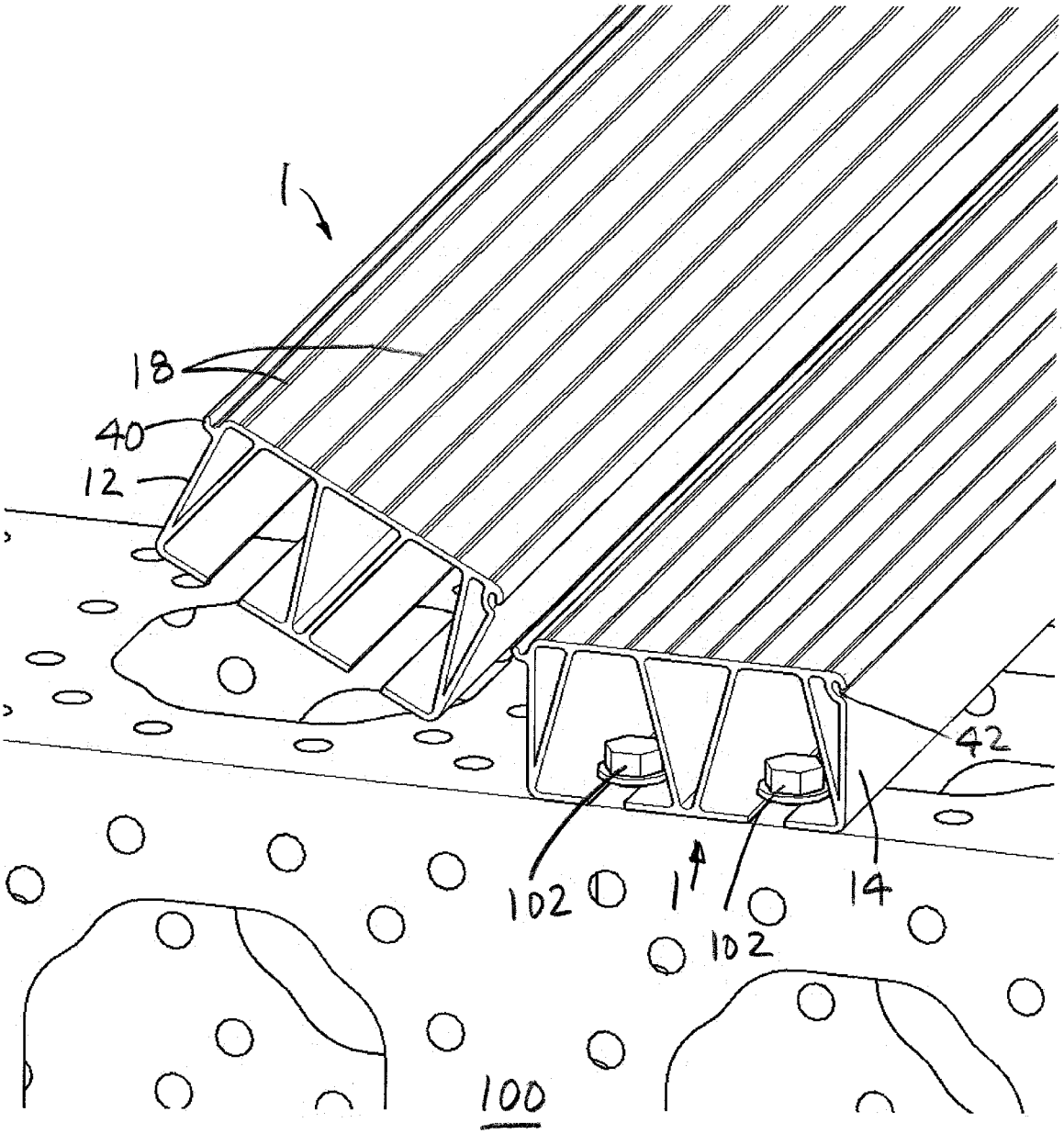
FIG. 2 is a partially exploded perspective view of a first aluminum extruded plank attached to a truss with a plurality of fasteners and an engagement hook slot of a second aluminum extruded plank about to be engaged with a lengthwise engagement hook of the first aluminum extruded plank in accordance with the present invention.

With reference now to the drawings, and particularly to FIG. 1, there is shown a front view of an aluminum extruded plank 1. With reference to FIG. 2, the aluminum extruded plank 1 preferably includes a top member 10, a first side member 12, a second side member 14 and a middle support member 16. The top member 10 preferably includes a plurality of lengthwise raised ridges 18 formed on a top surface thereof. The raised ridges 18 are an optional feature to increase friction and reduce slipping. The first side member extends 12 downward from a first end of the top member 10. The second side member 14 extends downward from a second end of the top member 10. A first bottom 20 member extends inward from a bottom end of the first side member 12. A second bottom member 22 extends inward from a bottom end of the second side member 14. A first gusset member 24 extends from a bottom and an inside surface of the first side member 12 to a bottom surface 26 of the top member 10. A second gusset member 28 extends from a bottom and an inside surface of the second side member to a bottom surface 26 of the top member 10. Openings (not shown) may be formed through the top member 10 to allow drainage of foams, oils, coolants and fire protection. The openings would also reduce the weight of the aluminum extruded plank 1. With reference to FIG. 2, the openings may be aligned and large enough to allow tightening of a plurality of fasteners 102 from above the top member 10.

The middle support member 16 preferably includes a first middle side member 30, a second middle side member 32 and a middle bottom member 34. One end of the first and second middle side members 30, 32 extend downward from the bottom surface 26 of the top member 10 and an opposing end of the first and second middle side members 30, 32 are terminated with the middle bottom member 34. A distance "A" across the one end of the first and second middle side members 30, 32 is greater than a distance "B" across the opposing ends of the middle side members 30, 32. A first lengthwise fastener slot 36 is created between an end of the first bottom member 20 and a first edge of the middle bottom member 34. A second lengthwise fastener slot 38 is created between an end of the second bottom member 22 and a second edge of the middle bottom member 34. A lengthwise engagement hook 40 preferably extends outward from an upper portion of the first side member. A lengthwise hook slot 42 is preferably formed in an upper portion of the second side member 14 to receive the lengthwise engagement hook 40. However, the lengthwise engagement hook 40 could also extend from the second side member 14 and the lengthwise hook slot 42 would extend from the first side member 12.

Figure 3:
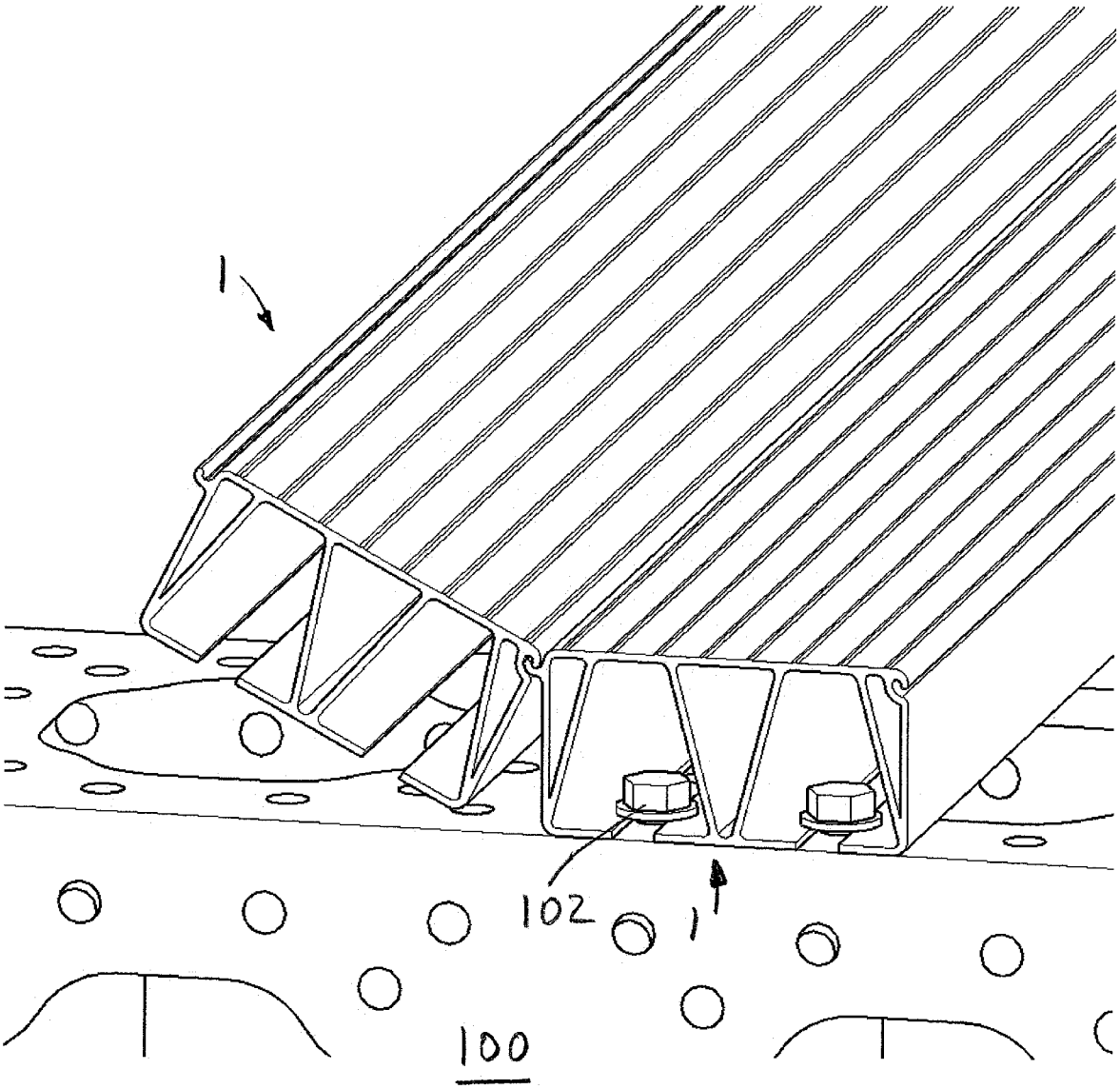
FIG. 3 is a perspective view of a first aluminum extruded plank attached to a truss with a plurality of fasteners and an engagement hook slot of a second aluminum extruded plank engaged with a lengthwise engagement hook of the first aluminum extruded plank in accordance with the present invention.
Figure 4:
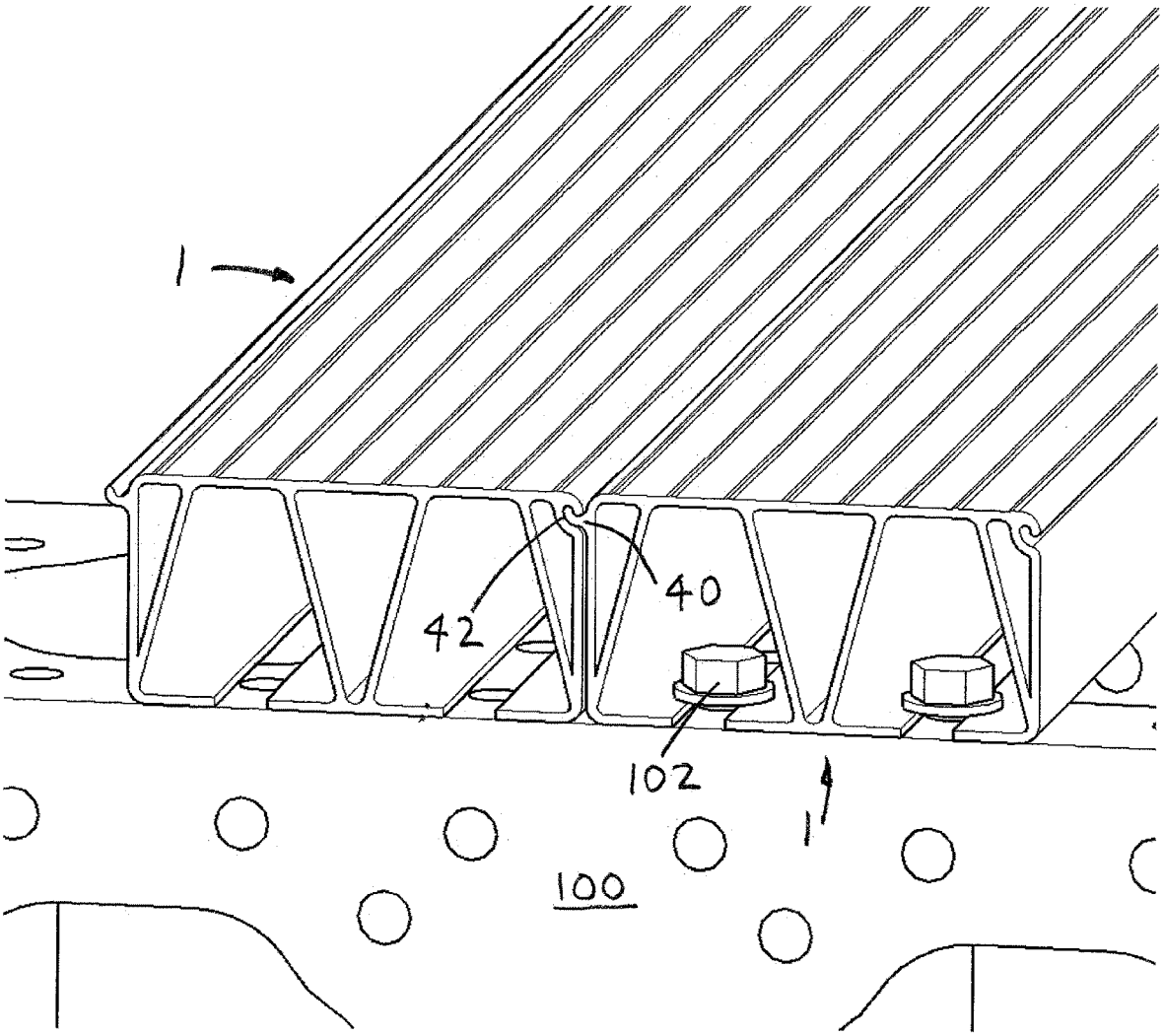
FIG. 4 is a perspective view of a first aluminum extruded plank attached to a truss with a plurality of fasteners and an engagement hook slot of a second aluminum extruded plank engaged with a lengthwise engagement hook of the first aluminum extruded plank and resting on the truss in accordance with the present invention.

With reference to FIGS. 3-4, the lengthwise hook slot 42 is sized and positioned to receive the lengthwise engagement hook 40 from an adjacent aluminum extruded plank 1. The lengthwise engagement hook 40 and the engagement hook slot 42 allow adjacent aluminum extruded planks 1 to be engaged with each other. The aluminum extruded planks 1 are attached to a support frame, which may be fabricated from a plurality of trusses 100 with the plurality of fasteners 102. The trusses 100 are preferably purchased from Mod-Truss of Allentown, Wisconsin.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

What is claimed:

1. An aluminum extruded plank, comprising:

a top member;

a first side member extends downward from a first end of said top member;

a second side member extends downward from a second end of said top member; and a middle support member includes at least one middle member and a middle bottom member, one end of said at least one middle member extends downward from a bottom surface of said top member, an opposing end of said at least one middle member is terminated with said middle bottom member, wherein a bottom of said first side member, said second side member and said middle bottom member are terminated by a single horizontal axis line, a vertical height of said first side member, said second side member and said middle support member is the same.

2. The aluminum extruded plank of claim 1, further comprising:

a first bottom member extends inward from a bottom of said first side member, a first lengthwise fastener slot is created between an end of said first bottom member and a first edge of said middle bottom member; and a second bottom member extends inward from a bottom of said second side member, a second lengthwise fastener slot is created between an end of said second bottom member and a second edge of said middle bottom member.

3. The aluminum extruded plank of claim 1, further comprising:

a first gusset member extends from a vertical inside surface of said first side member to a bottom surface of said top member.

4. The aluminum extruded plank of claim 3, further comprising:

a second gusset member extends from a vertical inside surface of the second side member to a bottom surface of said top member.

5. The aluminum extruded plank of claim 1, further comprising:

a lengthwise engagement hook extends outward from an upper portion of said first side member or said second side member; and a lengthwise hook slot is formed in an upper portion of said second side member or said first side member, said lengthwise hook slot is capable of receiving said lengthwise hook.

6. The aluminum extruded plank of claim 1, further comprising:

a lengthwise engagement hook extends outward from an upper portion of said first side member or said second side member; and a lengthwise hook slot is formed in an upper portion of said second side member or said first side member, said lengthwise hook slot is capable of receiving said lengthwise hook.

7. The aluminum extruded plank of claim 1, further comprising:

a lengthwise engagement hook extends outward from an upper portion of said first side member or said second side member; and a lengthwise hook slot is formed in an upper portion of said second side member or said first side member, said lengthwise hook slot is capable of receiving said lengthwise hook.

8. An aluminum extruded plank, a top member;

a first side member extends downward from a first end of said top member;

a first bottom member extends inward from a bottom of said first side member;

a second side member extends downward from a second end of said top member;

a second bottom member extends inward from a bottom of said second side member;

a middle support member includes at least one middle member and a middle bottom member, one end of said at least one middle member extends downward from a bottom surface of said top member, an opposing end of said at least one middle member is terminated with said middle bottom member, wherein a horizontal axis line passes through said first bottom member, said second bottom member and said middle bottom member, a vertical height of said first side member, said second side member and said middle support member is the same.

9. The aluminum extruded plank of claim 8, wherein:

a first lengthwise fastener slot is created between an end of said first bottom member and a first edge of said middle bottom member.

10. The aluminum extruded plank of claim 9, wherein:

a second lengthwise fastener slot is created between an end of said second bottom member and a second edge of said middle bottom member.

11. The aluminum extruded plank of claim 8, further comprising:

a first gusset member extends from a bottom and a vertical inside surface of said first side member to a bottom surface of said top member.

12. The aluminum extruded plank of claim 11, further comprising:

a second gusset member extends from a vertical inside surface of the second side member to a bottom surface of the top member.

13. An aluminum extruded plank, a top member;

a first side member extends downward from a first end of said top member;

a first gusset member has one end extend downward from a bottom of said top member, an opposing end of said first gusset member is joined to a vertical surface of said first side member;

a second side member extends downward from a second end of said top member;

a second gusset member has one end extend downward from a bottom of said top member, an opposing end of said second gusset member is joined to a vertical surface of said second side member;

a middle support member includes a first middle member, a second middle member and a middle bottom member, one end of said first and second middle members extend downward from a bottom surface of said top member, an opposing end of said first and second middle members are terminated with said bottom member.

14. The aluminum extruded plank of claim 13, further comprising:

a first bottom member extends inward from a bottom of said first side member, a first lengthwise fastener slot is created between an end of said first bottom member and a first edge of said middle bottom member.

15. The aluminum extruded plank of claim 14, further comprising:

a second bottom member extends inward from a bottom of said second side member, a second lengthwise fastener slot is created between an end of said second bottom member and a second edge of said middle bottom member.

* * * * *